United States Patent [19]

Massey

[11] 4,025,004

[45] May 24, 1977

[54] TOILET TISSUE ROLL HOLDER

[75] Inventor: Earl Massey, St. Petersburg, Fla.

[73] Assignee: Lawrence Peska Associates, Inc., New York, N.Y.

[22] Filed: Sept. 27, 1976

[21] Appl. No.: 727,373

[52] U.S. Cl. ..... 242/55.3; 242/58; 242/68

[51] Int. Cl.[2] ..... A47K 10/22

[58] Field of Search ..... 242/55.3, 55.2, 55.53, 242/58, 134, 139, 136, 137, 129.6, 129.62, 129.5, 129.51, 129.53, 129.7, 68, 68.4; 312/39

[56] References Cited

UNITED STATES PATENTS

| | | | |
|---|---|---|---|
| 2,108,333 | 2/1938 | Hardin et al. | 242/55.3 |
| 3,049,310 | 8/1962 | Wolfe | 242/55.3 |
| 3,101,181 | 8/1963 | Clelland et al. | 242/55.53 X |

*Primary Examiner*—George F. Mautz

[57] ABSTRACT

A holder for a pair of toilet tissue rolls is disclosed comprising a single mandrel which is divided in the center thereof, the ends of the mandrel being pivotally secured to a rack. A connecting member is provided where the mandrel is divided so that the mandrel may be secured in a substantially longitudinal configuration and alternately separated at the plane where the mandrel is divided.

5 Claims, 3 Drawing Figures

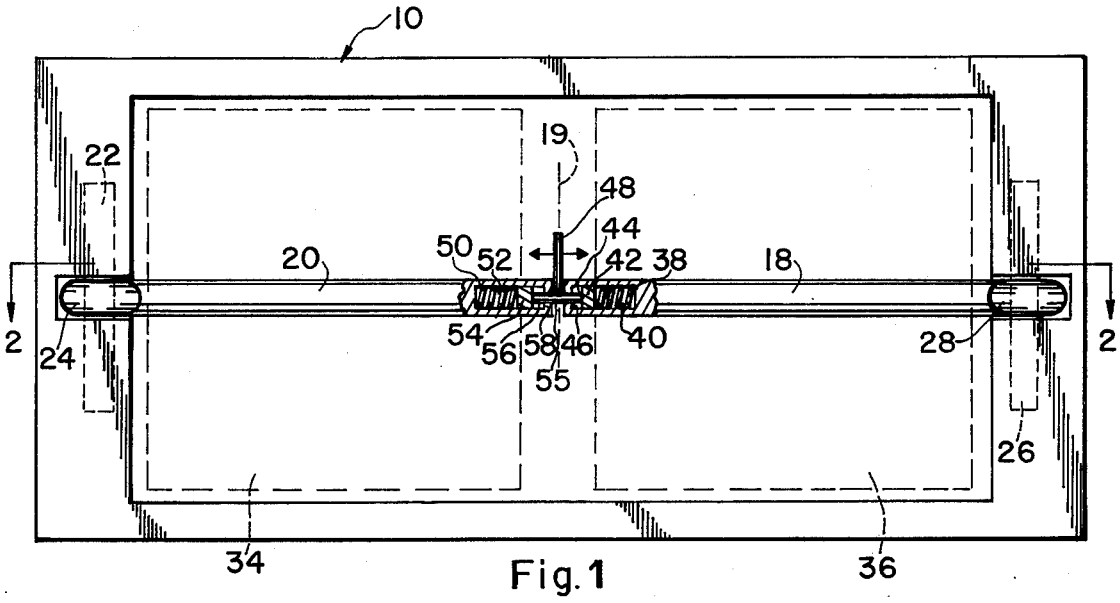
Fig. 1
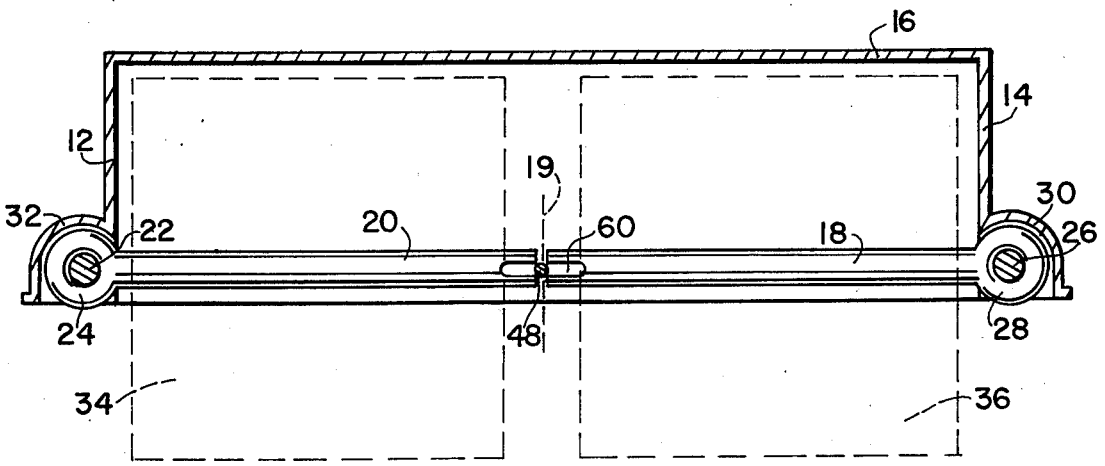
Fig. 2
Fig. 3
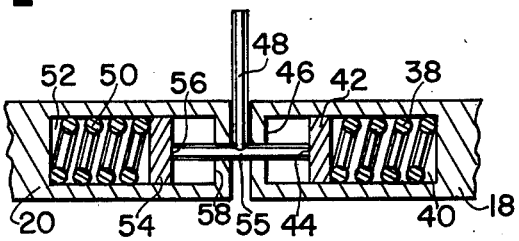

TOILET TISSUE ROLL HOLDER

SUMMARY OF THE INVENTION

The present invention relates to a holder for a pair of toilet tissue rolls comprising a frame having a pair of opposed side walls, the side walls being connected by a back wall, a mandrel being mounted in the frame for rollingly dispensing toilet tissue from a pair of toilet tissue rolls. The mandrel is divided at a plane at an angle to the axis thereof in two sections of substantially equal length. The connecting member is provided for releasably joining the sections at such plane. The ends of the mandrel opposite such plane are pivotally secured to the end walls through pivot members extending from the end walls to the end of the mandrel.

The connecting member may comprise an arrangement of recesses and plungers in which a first hollow recess is in the section of the mandrel extending from the plane towards one end of the mandrel, the first hollow recess running in the direction of the longitudinal axis of the mandrel. A second hollow recess is provided in the section of the mandrel extending from the plane towards the other end of the mandrel, the first hollow recess running in the direction of the longitudinal axis of the mandrel as well.

A first resilient member is provided in the first recess and a second resilient member is provided in the second recess. The first resilient member has a first ferromagnetic member extending therefrom on the end therof facing the plane and the second resilient member has a second ferromagnetic member extending therefrom on the end thereof facing the plane. A first restraining means is provided at the end of the first recess adjacent the plane for preventing the first ferromagnetic member from being moved out of the recess. A second restraining member is positioned at the end of the second recess adjacent the plane for also preventing the second ferromagnetic member from being moved out of the recess. An opening is provided in the first restraining member and an opening is also provided in the second restraining member. A magnetic plunger is positioned between the first ferromagnetic member and the second ferromagnetic member for moving in and out of the openings in the first and second restraining members. The first resilient member and the second resilient member resiliently bias the first ferromagnetic member and the second ferromagnetic member into the magnetic plunger so that the magnetic plunger is positioned to straddle the first and second recesses. A slot opening extends longitudinally along the mandrel above the first recess and the second recess. A bar extends upward from the magnetic plunger through said slot opening whereby the bar may be moved in the slot to disconnect the magnetic plunger from the second ferromagnetic member and position said plunger in the first recess or the bar may be moved in the slot to disconnect the magnetic plunger from the first ferromagnetic member and position the plunger in the second recess so that the mandrel may be opened at the plane and full toilet tissue rolls can be placed on the mandrel.

The length of the bar connected to the plunger may be at least as long as the diameter of a toilet tissue roll.

The pivot member may comprise a hinge member on the ends of said mandrel.

The plane at which the mandrel is divided may also be transverse to the longitudinal axis of the mandrel.

BRIEF DESCRIPTION OF THE SEVERAL VIEWS OF THE DRAWING

FIG. 1 comprises a front elevation in section of a holder for a pair of toilet tissue rolls according to one embodiment of the present invention;

FIG. 2 comprises a plan view taken along the line 2—2 of FIG. 1; and

FIG. 3 is a side elevation in section illustrating means for joining and separating a mandrel of the apparatus according to an embodiment of the invention.

DETAILED DESCRIPTION

Toilet paper dispensing apparatus is disclosed in the prior art U.S. Pat. Nos. 3,656,699 Schnyder, et al; 3,586,252 Sutton; 3,010,670 Jones et al; 2,805,030 Wolters; 2,619,297 Sharrer and 2,510,537.

It is an object of the present invention to provide a novel holder for a pair of toilet tissue rolls.

It is a further object of the present invention to provide such a holder for a pair of toilet tissue rolls in which the mandrel on which the rolls are rotatably positioned is pivotally secured to a frame the mandrel being divided into two sections intermediate the ends thereof, each section being sufficiently long for mounting a toilet tissue roll.

It is also an object of the present invention to provide novel connecting means for adjoining the aforementioned mandrel of a holder for a pair of toilet tissue rolls so that either roll may be removed or placed on said mandrel.

These and other objects have been achieved according to the present invention and will become apparent by reference to the disclosure and claims that follow as well as the appended drawing.

Referring to the drawing, a holder 10 is illustrated for holding a pair of toilet tissue rolls in which a frame in provided having a pair of opposed side walls 12, 14 connected by a back wall 16. The side walls 12 and 14 extend in arcuate projections 32 and 30 respectively for rotatably receiving hinge members 24 and 28 which are mounted on pins 22 and 26 respectively. The hinge member 24 extends into a mandrel section 20 and the hinge 28 extends into a mandrel section 18, the mandrels 18 and 20 lying along a common longitudinal axis and are divided so that each is of a sufficient length to hold a toilet tissue roll 34 and 36 respectively. Mandrel section 18 and mandrel section 20 are divided at a plane 19 indicated by broken line which is at an angle to the longitudinal axis of the mandrels, the plane in one embodiment being substantially transverse to the longitudinal axis of the mandrel sections 18 and 20. Mandrel section 18 has a first recess 40 therein for containing a resilient member 38 such as a coil spring, the longitudinal access of recess 40 being common with the longitudinal axis of the mandrel sections 18 and 20. A ferromagnetic member 42 is positioned at the end of the resilient member 38 and this comprises any ferromagnetic material known in the art such as iron, magnetite (magnetic iron oxide), nickel cobolt alloys such as aluminum nickel cobalt alloys and all of the art known equivalents thereof. Ferromagnetic member 42 is slidably mounted in recess 40 so that it may be moved in either direction along the longitudinal axis of the recess 40. A second recess 52 is provided in mandrel section 20, recess 52 having a resilient member 50 therein such as a coil spring, the longitudinal axis of recess 52 being common to the longitudinal axis of the mandrel sections 18 and 20. A ferromagnetic member 54 which is slidably mounted to move along the length of recess 52 in the direction of the longitudinal axis thereof is positioned at the end of resilient member 52, a restraining member 58 being positioned at the end of recess 52 in a manner similar to the restraining member 46 positioned at the end of the opening 40, the restraining member 54 preventing the ferromagnetic member 56 from exiting the recess 52 and the restraining member 46 preventing the ferromagnetic member 42 from exiting recess 40. A magnetic plunger 55 by which it is meant a plunger that may be a magnetic material such as that of the ferromagnetic members 42 and 54 is positioned to operatively engage the ferromagnetic members 54 and 42 through openings provided in the restraining members 58 and 46. The end 44 of the plunger is magnetically attracted to the ferromagnetic member 42 and the end 56 of the plunger is magnetically attracted to the ferromagnetic member 54. The magnetic plunger 55 extends upwardly into a broad like extension 48 which travels in a slot 60 in the mandrel 18 and slot 62 in mandrel 20.

In use, the rod 48 is slid into slot 60 to move plunger end 56 out of the opening in the restraining member 58 so that the mandrel sections 18 and 20 may be pivotally moved away from one another and the roll of toilet tissue 34 replaced. The length of the rod 48 is sufficient so that it extends beyond the radius of the toilet tissue rolls 36 and 34 so that when one roll is being replaced, the other will not be accidentally taken off of the mandrel. In order to remove roll 36 from the apparatus 10, the plunger 55 is moved so that the magnetic section 56 and the magnetic section 44 are moved into the recess 52 of mandrel 20 and the roll 36 pivoted on hinge 28 in pin 26 of mandrel 18 so that the roll 36 may be removed from the mandrel 18. Similarly the magnetic members 56 and 44 may be positioned in the recess 40 by moving the rod 48 into slot 60 thereby allowing roll 34 to be pivoted away from roll 36 through hinge 24 and pin 22 of mandrel 20 so that roll 34 may be replaced.

Although the invention has been described by reference to some embodiments, it is not intended that the novel holder for a pair of toilet tissue rolls be limited thereby but that modifications thereof are intended to be included as falling within the broad spirit and scope of the foregoing disclosure, the following claims and the appended drawing.

What is claimed is:

1. A holder for a pair of toilet tissue rolls comprising a frame having a pair of opposed side walls, said side walls being connected by a back wall, a mandrel mounted in said frame for rollingly dispensing toilet tissue from a pair of toilet tissue rolls, said mandrel being divided at a plane at an angle to the axis of said mandrel into two sections, each of a length to mount a toilet tissue roll, connecting means for releasably joining said sections at said plane, the ends of said mandrel opposite said plane being pivotally secured to said end wall through pivot means extending from said end walls to the ends of said mandrel.

2. The holder for a pair of toilet tissue rolls according to claim 1 where said connecting means comprises a first hollow recess in the section of said mandrel extending from said plane towards one end of said mandrel, said first hollow recess running in the direction of the longitudinal axis of said mandrel, a second hollow recess in the section of said mandrel extending from said plane towards the other end of said mandrel, said second hollow recess running in the direction of the longitudinal axis of said mandrel, a first resilient means in said first recess and a second resilient means in said second recess, said first resilient means having a first ferromagnetic means extending therefrom on the end thereof facing said plane, said second resilient means having a second ferromagnetic means extending therefrom on the end thereof facing said plane, a first restraining means at the end of said first recess adjacent said plane for preventing said first ferromagnetic means from being moved out of said recess, a second restraining means at the end of said second recess adjacent said plane for preventing said second ferromagnetic means from being moved out of said recess, an opening in said first restraining means and an opening in said second restraining means, a magnetic plunger means positioned between said first ferromagnetic means and said second ferromagnetic means, said first resilient means and said second resilient means resiliently biasing said first ferromagnetic means and said second ferromagnetic means into said magnetic plunger means, so that said magnetic plunger is positioned to straddle said first and second recesses, a slot opening ending longitudinally along said mandrel above said first recess and said second recess, a bar extending upwardly from said magnetic plunger means through said slot whereby said bar may be moved in said slot to disconnect said magnetic plunger from said second ferromagnetic means and positions said plunger in said first recess, said bar also being movable in said slot to disconnect said magnetic plunger from said first ferromagnetic means and position said plunger in said second recess so that said mandrel may be opened at said plane and full toilet tissue rolls can be placed on said mandrel.

3. The holder for a pair of toilet tissue rolls according to claim 2 where the length of said bar is at least as long as the radius of a toilet tissue roll.

4. The holder for a pair of toilet tissue rolls according to claim 2 where said pivot means comprises hinge means on the ends of said mandrel.

5. The holder for a pair of toilet tissue rolls according to claim 2 where said plane in transverse to the longitudinal axis of said mandrel.

* * * * *